US011246347B2

(12) United States Patent
Reevell

(10) Patent No.: US 11,246,347 B2
(45) Date of Patent: Feb. 15, 2022

(54) AEROSOL-GENERATING DEVICE WITH INDUCTION HEATER AND MOVABLE COMPONENT

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 159 days.

(21) Appl. No.: 16/637,094

(22) PCT Filed: Aug. 6, 2018

(86) PCT No.: PCT/EP2018/071266
§ 371 (c)(1),
(2) Date: Feb. 6, 2020

(87) PCT Pub. No.: WO2019/030172
PCT Pub. Date: Feb. 14, 2019

(65) Prior Publication Data

US 2020/0245682 A1 Aug. 6, 2020

(30) Foreign Application Priority Data

Aug. 9, 2017 (EP) ..... 17185570

(51) Int. Cl.
*A24F 13/00* (2006.01)
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
CPC ..... A24F 47/00
(Continued)

(56) References Cited

U.S. PATENT DOCUMENTS 6,053,176 A 4/2000 Adams et al.
2014/0301721 A1 10/2014 Ruscio et al.
(Continued)

FOREIGN PATENT DOCUMENTS

RU 2 604 313 C2 12/2016
WO WO 2013/060743 A2 5/2013
(Continued)

OTHER PUBLICATIONS

International Search Report and Written Opinion dated Jan. 4, 2019 in PCT/EP2018/071266 filed Aug. 6, 2018.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a housing having a chamber configured to receive at least a portion of an aerosol-generating article; and an induction heater configured to heat the aerosol-generating article received within the chamber of the housing, the induction heater including an induction coil and a heating element, the heating element being arrangeable within the induction coil, and the induction coil being movable relative to the chamber of the housing, the induction coil and the heating element being moveable with respect to each other between at least a first operable position and a second operable position.

14 Claims, 10 Drawing Sheets

(58) Field of Classification Search
USPC ..... 131/328–329
See application file for complete search history.

(56) References Cited

U.S. PATENT DOCUMENTS

| | | | | |
|---|---|---|---|---|
| 2015/0223292 | A1 | 8/2015 | Duffield et al. | |
| 2016/0228658 | A1 | 8/2016 | Minskoff | |
| 2020/0390156 | A1* | 12/2020 | An | H04W 12/037 |

FOREIGN PATENT DOCUMENTS

| | | | |
|---|---|---|---|
| WO | WO 2016/033242 | A1 | 3/2016 |
| WO | WO 2017/0681 01 | A1 | 4/2017 |

OTHER PUBLICATIONS

Decision to Grant dated Oct. 16, 2020 in Russian Patent Application No. 2020105879/03.
European Office Action dated Feb. 26, 2021 in European Patent Application No. 18746728.7, 5 pages.

* cited by examiner

AEROSOL-GENERATING DEVICE WITH INDUCTION HEATER AND MOVABLE COMPONENT

CROSS-REFERENCE TO RELATED APPLICATIONS

This application is a U.S. national stage application of PCT/EP2018/071266, filed on Aug. 6, 2018, which is based upon and claims the benefit of priority from European patent application no. 17185570.3, filed Aug. 9, 2017, the entire contents of each of which are incorporated herein by reference.

TECHNICAL FIELD

The present invention relates to an aerosol-generating device comprising a housing having a chamber for receiving an aerosol-generating article and an induction heater for heating an aerosol-forming article received within chamber of the housing. The induction heater comprises an induction coil and a heating element, wherein the heating element is arrangeable within the induction coil.

DESCRIPTION OF THE RELATED ART

It is known to employ different types of heaters in aerosol-generating articles for generating an aerosol. Typically, resistance heaters are employed for heating an aerosol-forming substrate such as an e-liquid. It is also known to provide "heat not burn" devices utilizing resistance heaters, which generate an inhalable aerosol by heating but not burning an aerosol-forming substrate containing tobacco.

Induction heaters offer advantages and have been proposed in the above devices. Induction heaters are for example described in US 2017/055580 A1. In induction heaters, an induction coil is arranged around a component made from a conductive material. The component may be denoted as a heating element or susceptor. A high-frequency AC current is passed through the induction coil. As a result, an alternating magnetic field is created within the induction coil. The alternating magnetic field penetrates the heating element thereby creating eddy currents within the heating element. These currents lead to a heating of the heating element. In addition to heat generated by eddy currents, the alternating magnetic field may also cause the susceptor to heat due to the hysteresis mechanism. Some susceptors may even be of a nature that no, or almost no, eddy currents will take place. In such susceptors substantially all the heat generation is due to hysteresis mechanisms. Most common susceptors are of such a kind, where heat is generated by both mechanisms. A more elaborate description of the processes and responsible for generating heat in a susceptor, when penetrated by an alternating magnetic field may be found in WO2015/177255. Inductive heaters facilitate rapid heating which is beneficial for generating an aerosol during the operation of the aerosol-generating device.

It would be desirable to have an aerosol-generating device with an induction heater in which the heating of a consumable can be varied. It would further be desirable to realize a variable heating without adding significant structural complexity to the device.

SUMMARY

According to a first aspect of the invention there is provided an aerosol-generating device comprising a housing having a chamber configured to receive at least a portion of an aerosol-generating article. The device further comprises an induction heater for heating an aerosol-forming article received within the chamber of the housing. The induction heater comprises an induction coil and a heating element, wherein the heating element is arrangeable within the induction coil. The induction coil and the heating element are configured moveable with respect to each other between at least a first operable position and a second operable position. Preferably, the induction coil is movable relative to the chamber of the housing.

BRIEF DESCRIPTION OF THE DRAWINGS

The invention will be further described, by way of example only, with reference to the accompanying drawings in which.

DETAILED DESCRIPTION

Figures 1A, 1B, 1C, 1D:
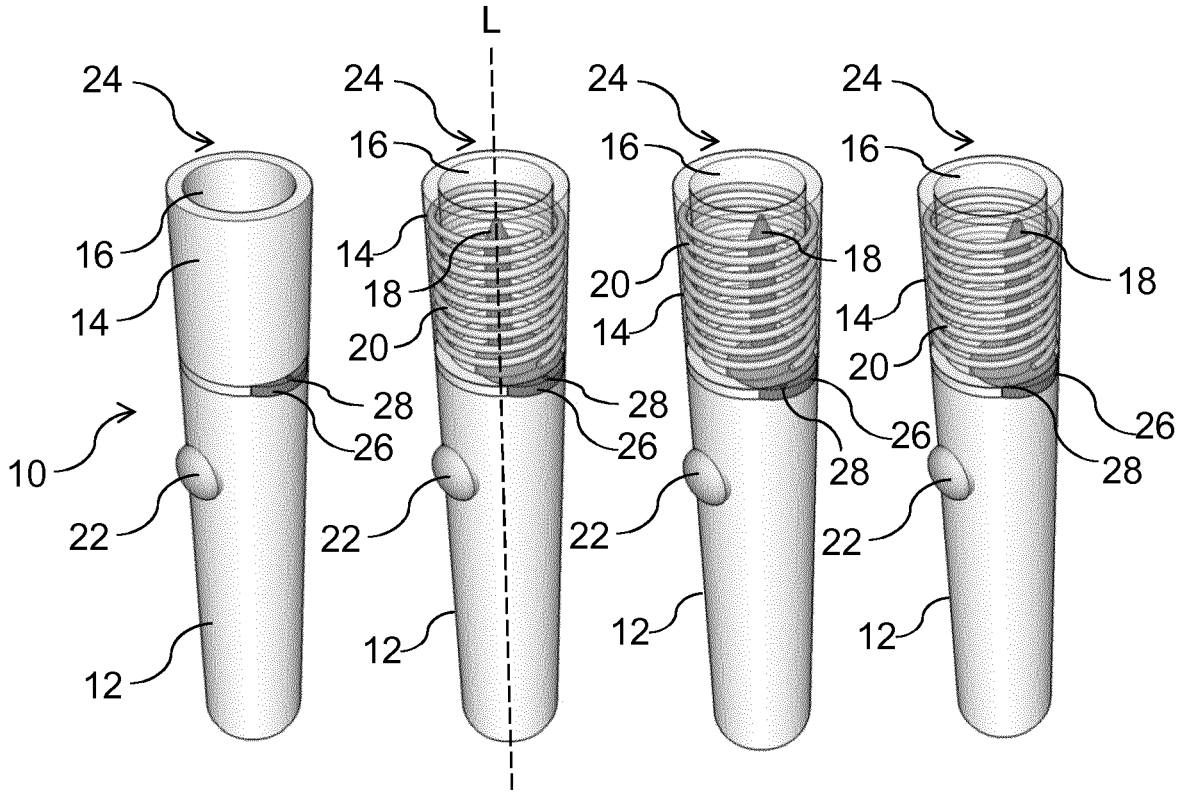
FIG. 1 shows an aerosol-generating device with a movable heating element by means of a dial shaped base section.

An operable position denotes a position in which the heating element penetrates an aerosol-generating article and is heatable. During operation of the induction heater, an aerosol is generated by the heating element heating the inserted aerosol-generating article.

Aerosol-forming substrate containing tobacco may be provided in the form of an aerosol-generating article. The aerosol-generating article may be provided as a consumable such as a tobacco stick. In the following, the aerosol-generating article will be denoted as a consumable. These consumables may have an elongate rod-like shape. Such a consumable is typically pushed into a cavity of the chamber of the device. In the chamber, the heating element of the induction heater penetrates the aerosol-forming substrate in the consumable during insertion of the consumable. Once the aerosol-forming substrate in the consumable is used after multiple heating cycles of the induction heater, the consumable is removed and replaced by a new consumable. The generation of an aerosol depends, among others, upon the position of the heating element within the consumable and the shape and temperature of the heating element. Given a specific heating element, the position and temperature of the heating element are the prime factors for aerosol generation. Aerosol is generated by heating the heating element and drawing air through the consumable due to a puff of a user.

The aerosol-forming substrate in the consumable is heated by the heating element and releases volatile components. The air enriched with the volatile components then condenses to form an aerosol that is subsequently inhaled by a user.

Different users may have different preferences such as the amount of volatile components generated during aerosol generation. The invention enables controlling the aerosol generation by changing the relative positions of the heating element and the induction coil of the induction heater. Varying the relative orientations of the heating element and inductor coil will lead to variances in the effectiveness in the transfer of power to the heating element, because the magnetic flux through the heating element strongly depends on the relative orientation of these the heating element and the coil, for any given frequency and amplitude used for the AC current applied to the induction coil. Hence, a change in the relative orientation of the heating element and induction coil may affect both how hot the heating element may become and how long time it will take the heating element to reach the operating temperature optimal for aerosol generation. Furthermore, a part of the heating element may be heated to a higher temperature than another part, which other part is mainly heated by conduction. Hence, different regions of the substrate could be specifically heated by changing the operational position of the heating element. Consequently, the positioning of the heating element within the consumable may result in a different heating effect and give the individual user a large degree of flexibility in adopting the user experience to his or her particular taste and needs.

Preferably, the housing of the aerosol-generating device, the consumable inserted into the chamber of the device, the chamber and the induction coil all have the same longitudinal axis or direction which is a central axis along the length of the above components.

The heating element and coil may have an elongate shape. The heating element may have the same length as the coil. The heating element may have the shape of a pin or blade. The heating element may be solid while the coil may have a helical shape such that the heating element can be arranged within the coil. The coil may be provided as a helical wound coil with the shape of a helical spring. The coil may comprise contact elements such that an AC current can flow through the coil from a power supply. The AC current supplied to the induction coil is preferably a high frequency AC current. For the purpose of this application, the term "high frequency" is to be understood to denote a frequency ranging from about 1 Megahertz (MHz) to about 30 Megahertz (MHz) (including the range of 1 MHz to 30 MHz), in particular from about 1 Megahertz (MHz) to about 10 MHz (including the range of 1 MHz to 10 MHz), and even more particularly from about 5 Megahertz (MHz) to about 7 Megahertz (MHz) (including the range of 5 MHz to 7 MHz). No direct or electrical connection needs to be established between the coil and the heating element, since the magnetic field generated by the coil penetrates the heating element and thereby heats the heating element by the mechanisms explained above. These mechanisms are eddy currents and hysteresis losses, which are converted into heat energy. The coil as well as the heating element may be made from a conductive material such as metal. The heating element and the coil may have a circular, elliptical or polygonal shaped cross-section. The induction coil may be arranged within the housing of the device to be protected. The housing may be made from a material not susceptible to being heated, when penetrated by an alternating magnetic field. For example, the housing may be made from a non-conductive material such that no eddy currents are generated in the housing, and which is also not heatable through hysteresis mechanisms. In other words, the housing may be made from a non-susceptor material, for example a non-conductive, non-susceptor material. The whole housing of the device may be made from a non-conductive material. Alternatively, the section of the housing adjacent to the induction coil may be made from a non-conductive material.

In the first operable position, a first portion of the heating element may be surrounded by the induction coil. In the second operable position, a second portion of the heating element may be surrounded by the induction coil, wherein the first and second portions of the heating element may not overlap. If the heating element has penetrated a consumable, first and second portions of the aerosol-forming substrate are positioned adjacent to the portions of the heating element. During operation of the induction heater, the first portion of the substrate may be heated in the first position of the heating element and the second portion of the substrate may be heated in the second position of the heating element.

The heating element may be movable relative to the chamber of the housing. The heating element may be movable in a longitudinal direction of the chamber. The heating element may penetrate the consumable and the consumable may subsequently be moved by the heating element along the longitudinal direction of the chamber. The aerosol-forming substrate in the consumable may be successively heated by advancing the heating element, for example after each puff of a user. The user may change the position of the heating element along the longitudinal direction of the chamber.

The aerosol-generating device may further comprise a guiding element configured to restrict the movement of the heating element within the chamber.

The aerosol-generating device may comprise a sliding actuator configured to move the heating element within the chamber. The sliding actuator may enable a movement of the heating element without directly contacting the heating element. The sliding actuator may be arranged at a side surface of the housing of the device such that the actuator can be used without opening the device. Connecting means may be arranged for connecting the actuator with the heating element which is arranged inside of the chamber of the device. The connecting means may be configured for conveying a movement of the sliding actuator into a movement of the heating element.

The first and second portions of the heating element may be thermally isolated from each other. The two heating regions may be electrically conductive. The two heating regions may be separated from each other by electrically non-conductive material. Essentially no eddy currents may be generated in one of the heating region, if the other heating region is surrounded by an induction coil through which an AC current flows. The heating regions may be thermally insulated such that a heating region is not heated while the other heating region is heated. By the heating regions, portions of the aerosol-forming substrate in the consumable may be heated essentially without other portions of the aerosol-forming substrate in the consumable being heated.

The induction coil may be arranged in walls within the housing surrounding the chamber. By arranging the induction coil in walls within the housing, the induction coil may be protected from contamination and damage. The induction coil may extend essentially over one half the length of the chamber with respect to the longitudinal axis of the device. By limiting the length of the induction coil to a fraction, such as essentially half the length, of the chamber, partial portions of the aerosol-forming substrate in the consumable may be heated. The portion of the heating element which is surrounded by the induction coil may be heated, since eddy currents are generated in this portion of the heating element if an AC current flows though the induction coil. The induction coil may be arranged adjacent the proximal end of the chamber. The consumable may be inserted into the proximal end.

The heating element may have a length which corresponds to the length of the chamber. After the portion of the consumable, which has been heated, is depleted (for example in the sense that no more satisfying aerosol may be generated), the heating element inside of the consumable may be moved, thereby moving the heating element into contact with a fresh part of the aerosol-forming substrate within the consumable. The heating element may be moved half the length of the chamber such that the portion of the consumable, which was not heated by the induction heater, is now surrounded by the induction coil and can be heated. Thus, sections of the consumable may be heatable by moving the consumable by means of the heating element through the induction coil.

The induction coil may be movable in a longitudinal direction of the chamber. Similar to the heating element being configured movable in a longitudinal direction of the chamber, a movable induction coil may facilitate that different portions of the aerosol-forming substrate in the consumable may be heatable. The induction coil may, according to this aspect, surround a fraction of the chamber such as half the length of the chamber. When the consumable is inserted into the chamber and the heating element penetrates the consumable, the induction coil may surround a portion of the consumable which is subsequently heated for aerosol generation. Thereafter, the induction coil may be moved in a longitudinal direction of the chamber such that a different portion of the consumable is surrounded by the induction coil. This different portion of the consumable may then be heated.

The aerosol-generating device may comprise a guiding element configured to restrict the movement of the induction coil relative to the chamber of the device. A safe movement of the induction coil along the length of the chamber may thus be facilitated.

The heating element may be movable in a transverse direction of the chamber. The transverse direction of the chamber extends perpendicular to the longitudinal direction of the chamber. The heating element may comprise a base section. The heating element may be elongate and extend perpendicular to the base section into the cavity of the housing. The base section may be configured to move between a first position in which the heating element is aligned with the central axis of the induction coil, and a second position in which the heating element is not aligned with the central axis of the induction coil. Thus, the base section may be configured for moving the heating element off-center with respect to the central axis of the induction coil. The base section may be formed at the base of the heating element for mounting the heating element within the induction coil. The base section may be made of a thermally insulating material. The base section may be made of an electrically non-conductive material. The base section may allow air to be drawn through the base section.

The base section may comprise a dial. A dial enables that the position of the heating element relative to the central axis of the induction coil may be changed by rotating the dial. The base section may comprise a marker indicating the dial rotation. The base section may at least partially extend out of the housing of the device such that a user may be able to see and operate the dial. A marker on the exposed part of the dial may give a visual indication for the user in which position the dial is, and, as a consequence, in which position the heating element is.

The base section may comprise a pin for mounting the base section. The pin may be arranged off-center with respect to the central axis of the induction coil. The dial may be configured to pivot about the pin. In this way, a rotation of the dial may lead to the heating element being moved away from the central axis of the induction coil. The heating element may be arranged along the central axis of the induction coil in the first operable position. When a consumable is pushed into the chamber of the device over the heating element, the heating element may penetrate the consumable at the center of the consumable. This arrangement of the heating element may be utilized in a standard heating effect. When the dial is rotated, the heating element may be moved nearer to one side of the induction coil. In this way, if a consumable is inserted into the chamber of the device after the heating element has been moved by a rotation of the dial, the heating element is inserted into the consumable off-center. Thus, a different heating effect may be created by a movement of the heating element due to a dial rotation. In this regard, side portions of the aerosol-forming substrate may be heated by the off-center heating element. The off-center position of the heating element may be the second operable position. The aerosol-forming substrate may be used more efficiently if the consumable is repeatedly removed and inserted into the chamber of the device such that different side portions of the aerosol-forming substrate are heated each time. In this regard, the consumable may be rotated during each removal-insertion cycle. Also, the dial may be slightly rotated during each removal-insertion cycle.

The base section may comprise a sliding element configured to slide relative to a slot in the housing. This may enable a linear movement of the heating element from a central position within the induction coil towards an off-center position. The heating effect may be controlled by sliding the heating element between the center position and the off-center position. The movement of the heating element between the center position and the off-center position may be facilitated by the sliding element. The base section and the sliding element may have a complementary shape such as a tongue and groove shape.

The invention also relates to an aerosol-generating system comprising an aerosol-generating article comprising an aerosol-generating substrate and an aerosol-generating device as described above.

The length of the chamber with respect to the longitudinal axis of the device may be larger than the length of the induction coil, and the induction coil may be arranged adjacent the proximal end of the chamber. Heating of a consumable inserted into the chamber may be varied by the positioning of the consumable within the chamber.

According to this aspect, the heating element and the induction coil may be arranged stationary, while only the consumable may be movable within the chamber of the device. Since the induction coil surrounds only a fraction of the chamber, only a portion of the consumable and the aerosol-forming substrate in the consumable is heated when the consumable is inserted into the chamber. Subsequently, the consumable may be pulled away from the chamber such that the consumable is still situated within the chamber but does not fully extend into the chamber anymore. As a consequence, the induction coil may now surround a different region of the consumable. In this way, different portions of the consumable may be subsequently heated by pulling out the consumable incrementally out of the chamber.

The heating element may be arranged along the longitudinal axis of the induction coil, wherein the heating element may have a length which is essentially the same as the longitudinal length of the induction coil. In this way, only the heating element which is surrounded by the induction coil may be heated.

The device may comprise a controller. The controller may comprise a microprocessor, which may be a programmable microprocessor. The controller may comprise further electronic components. The controller may be configured to regulate a supply of electric power to the induction heater. Electric power may be supplied to the induction heater continuously following activation of the device or may be supplied intermittently, such as on a puff-by-puff basis. The power may be supplied to the induction heater in the form of pulses of electrical current.

The device may comprise a power supply, typically a battery. As an alternative, the power supply may be another form of charge storage device such as a capacitor. The power supply may require recharging and may have a capacity that allows for the storage of enough energy for one or more puffs; for example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction heater.

The consumable may comprise an aerosol-forming substrate. The aerosol-forming substrate may comprise homogenised tobacco material. The aerosol-forming substrate may comprise an aerosol-former. The aerosol-forming substrate preferably comprises homogenised tobacco material, an aerosol-former and water. Providing homogenised tobacco material may improve aerosol generation, the nicotine content and the flavour profile of the aerosol generated during heating of the aerosol-generating article. Specifically, the process of making homogenised tobacco involves grinding tobacco leaf, which more effectively enables the release of nicotine and flavours upon heating.

The induction heater may be triggered by a puff detection system. Alternatively, the induction heater may be triggered by pressing an on-off button, held for the duration of the user's puff.

The puff detection system may be provided as a sensor, which may be configured as an airflow sensor and may measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff.

An aerosol-generating device as described above and a consumable may be an electrically operated smoking system. Preferably, the aerosol-generating system is portable. The aerosol-generating system may have a size comparable to a conventional cigar or cigarette. The smoking system may have a total length between approximately 30 millimetres and approximately 150 millimetres. The smoking system may have an external diameter between approximately 5 millimetres and approximately 30 millimetres.

FIG. 1 shows an aerosol-generating device 10. The aerosol-generating device 10 comprises a housing with a first housing portion 12 and a second housing portion 14. The first housing portion 12 comprises a battery and a controller. The second housing portion 14 comprises a chamber 16 for inserting a consumable containing aerosol-forming substrate. The second housing portion 14 further comprises an induction heater with a heating element 18 and an induction coil 20. The induction coil 20 is arranged within the second housing portion 14. The heating element 18 is arranged in a cavity within the chamber 16 surrounded by the induction coil 20. The controller is provided to control the supply of electrical energy from the battery to the induction heater. The induction heater is activated by pressing a button 22. The induction heater is deactivated by releasing the button 22. A user may insert a consumable containing aerosol-forming substrate into the chamber 16 at a proximal end 24. Subsequently, the user may press the button 22 while drawing on the consumable and inhale the generated aerosol.

From left to right, FIGS. 1*a*, 1*b*, 1*c* and 1*d* are presented. FIG. 1*a* shows the above described aerosol-generating device 10. At a side surface of the aerosol-generating device 10, a base section 26 of the heating element 18 is partially visible. The base section 26 is arranged at the base of the heating element 18 and has the shape of a dial. The base section 26 is mounted off-center with respect to the central axis L of the induction coil 20.

FIG. 1*b* shows the aerosol-generating device 10 with a transparent second housing portion 14 such that the induction coil 20 within the second housing portion 14 can be seen. In FIG. 1*b*, the base section 26 is rotated such that the heating element 18 is arranged along the central axis L of the induction coil 20. In other words, the heating element is in FIG. 1*b* arranged in a first operable position within the chamber 16. In FIGS. 1*c* and 1*d*, the base section 26 is rotated such that the heating element 18 is moved off-center away from the central axis L of the induction coil 20 to a second operable position. From the outside of the aerosol-generating device 10, this movement is indicated by a marker 28 on the base section 26.

Figures 2A, 2B, 2C:
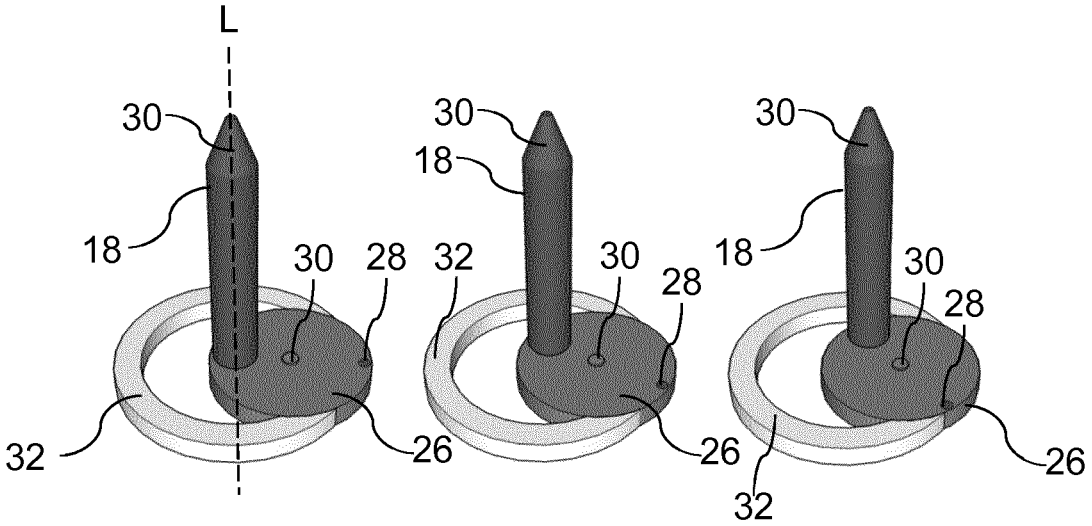
FIG. 2 shows a detailed view of the heating element and the dial shaped base section.

FIG. 2 shows a detailed view of the heating element 18 and the base section 26. The heating element 18 comprises a tapered tip 30 for facilitating the penetration of a consumable by the heating element 18. The dial shaped base section 26 with the marker 28 indicating the position of the base section 26 are depicted in detail in FIG. 2. In the left part of FIG. 2, FIG. 2*a*, the base section 26 is depicted in a first operable position in which the heating element 18 is arranged in a central position aligned along the central axis L of the induction coil 20. In the middle and right parts of FIG. 2, FIGS. 2*b* and 2*c*, the base section 26 is rotated such that the heating element 18 is arranged off-center. For facilitating this movement, the base section 26 is mounted by means of a pin 30, wherein the pin 30 is arranged off-center with respect to the central axis L of the induction coil 20. Also depicted in FIG. 2 is a ring 32 for restricting the movement of the base section 26 and mounting the base section 26 between the first and second housing portions 12, 14.

Figure 3A:
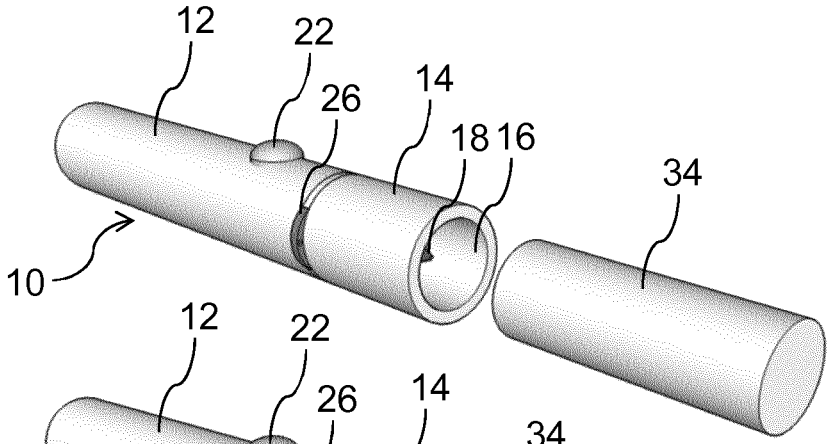
FIG. 3 shows the aerosol-generating device with an inserted consumable.
Figure 3B:
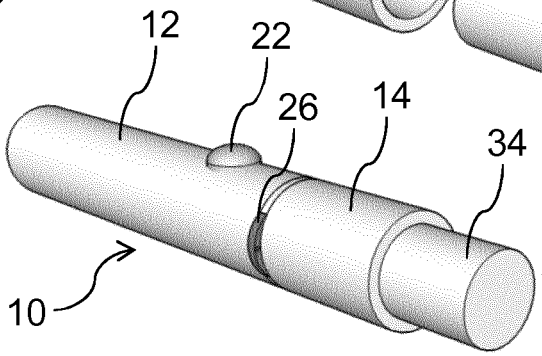

FIG. 3 shows the aerosol-generating device 10, wherein a consumable 34 is inserted into the aerosol-generating device 10. In FIG. 3*a*, the consumable 34 has not yet been inserted into the chamber 16 of the device 10 and the heating element 18 is arranged in a first operable position within the chamber 16. By rotating the base section 26, the heating element 18 could at this stage be moved to a second operable position if desired by a user. In FIG. 3*b*, the consumable 34 has been inserted into the chamber 16 of the device 10.

Figures 4A, 4B, 4C:
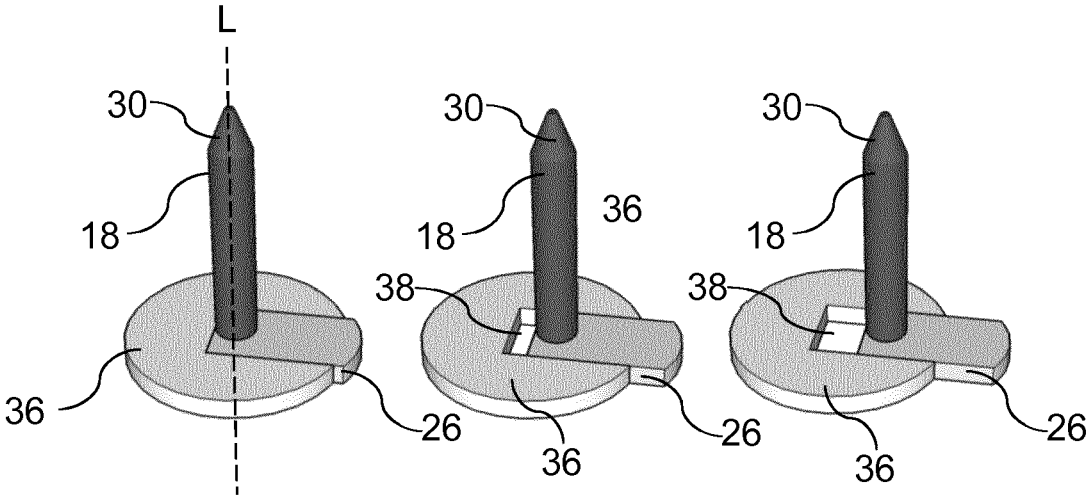
FIG. 4 shows an embodiment of the aerosol-generating device with a slide shaped base section.

FIG. 4 shows an embodiment of the base section 26, in which the base section 26 has the shape of a sliding element. The base section 26 can be slided in a slot between the first and second housing portions 12, 14 such that the position of the heating element 18 within the chamber 16 can be changed. The heating element 18 is in FIG. 4*a* aligned along the central axis L of the induction coil 20 in the first operable position. In FIGS. 4*b* and 4*c*, the base section 26 is slided out of the device 10 such that the heating element 18 is arranged in a second operable position. The base section 26 is held in an element 36 which has a complementary shape. The base section 26 and the element 36 may have a tongue and groove shape such that the base section 26 can slide along the chamber 38 in the element 36.

Figures 5A, 5B, 5C:
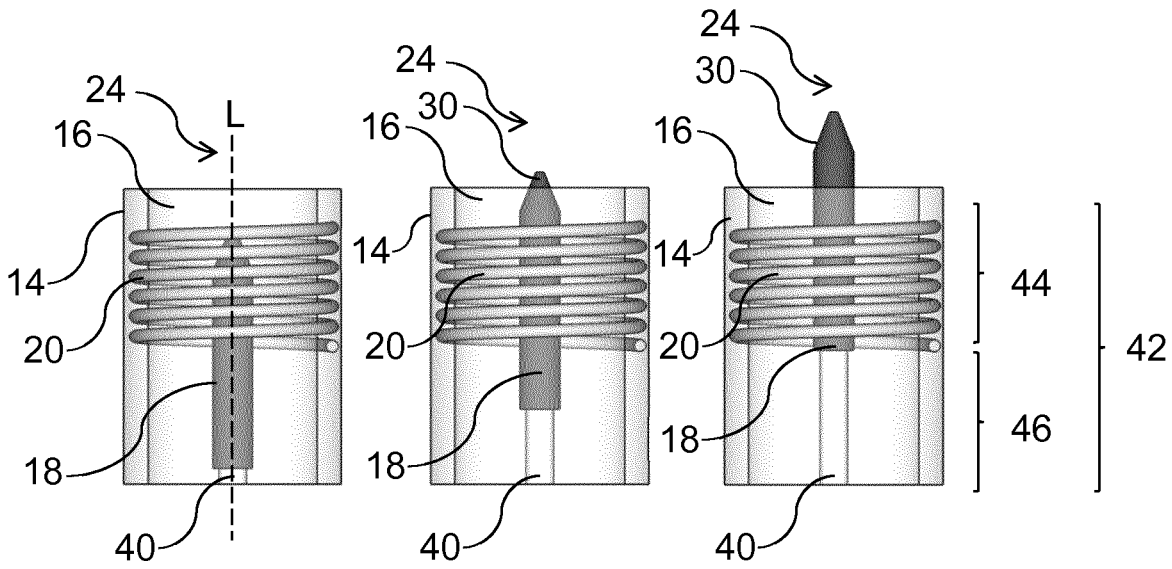
FIG. 5 shows an embodiment of the induction coil surrounding a fraction of the length of the chamber and of an embodiment in which the heating element is movable along the central axis of the induction coil.

FIG. 5 shows an embodiment in which the heating element 18 is aligned along the central axis L of the induction coil and movable along the central axis L. From FIGS. 5*a* to 5*c*, the heating element 18 is moved along the central axis L. The heating element 18 is mounted on a support member 40 so as to enable a movement of the heating element 18. The support member 40 may be manually moved or moved by a mechanism such as a linear motor in the first housing portion 12.

FIG. 5 also shows the heating element 18 arranged in the chamber 16 of the second housing portion 14. In this embodiment, the induction coil 20 is not arranged along the full length 42 of the chamber 16. Rather, the induction coil 20 extends essentially half the length 44 of the chamber 16, while the other half length 46 of the chamber is not surrounded by the induction coil 20. The induction coil 20 is arranged near the proximal end 24 such that when a consumable 34 is inserted into the chamber, only a part of the consumable 34 is surrounded by the induction coil 20 for heating this part of the consumable 34. The movable heating element 18 may be used after penetrating a consumable 34 to move the consumable 34 partially out of the chamber 16. In this way, the part of the consumable 34 can then be heated which has not yet been heated by the heating element 18 surrounded by the induction coil 20.

Figures 6A, 6B, 6C, 6D:
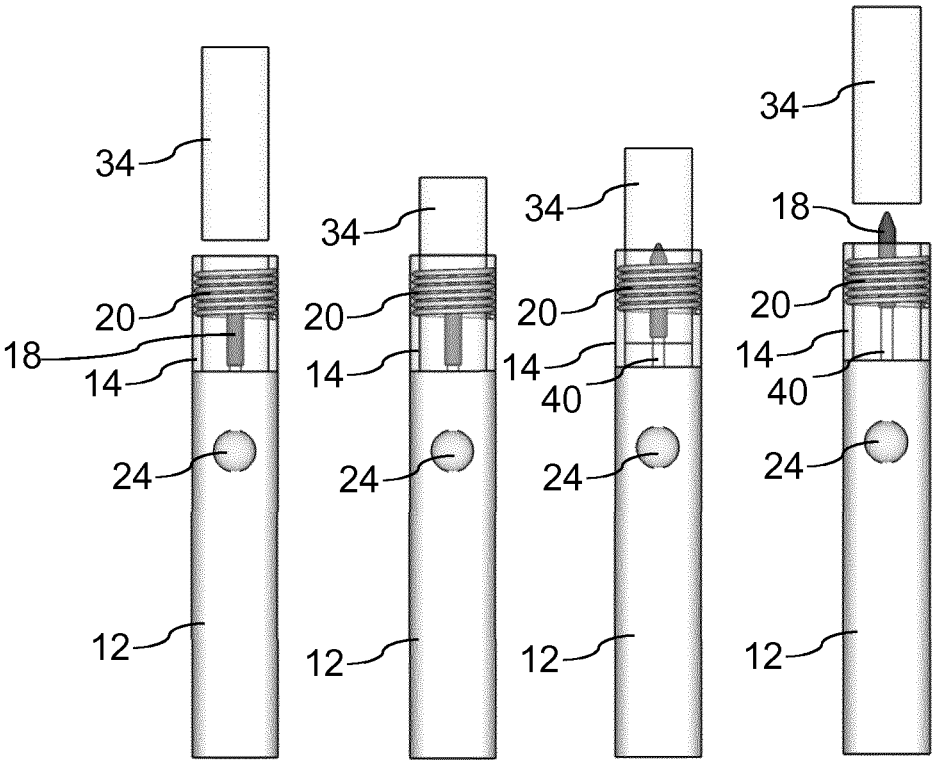
FIG. 6 shows the induction heater of FIG. 5 used in an aerosol-generating device and an inserted consumable.

FIG. 6 shows the embodiment of FIG. 5, wherein a consumable 34 is not yet been inserted into the chamber 16 in FIG. 6*a*. In FIG. 6*b*, the consumable 34 is fully inserted into the chamber 16 and over the heating element 18 such that a portion of the consumable 34 surrounded by the induction coil 20 can be heated in a first operable position. In FIG. 6*c*, the consumable 34 has been partly pushed out of the chamber 16 by the movement of the heating element 18. Thus, a different part of the consumable 34 may be heated in a second operable position. In FIG. 6*d*, the consumable 34 has been pushed even further out of the chamber 16 by the heating element 18.

Figures 7A, 7B, 7C, 7D:
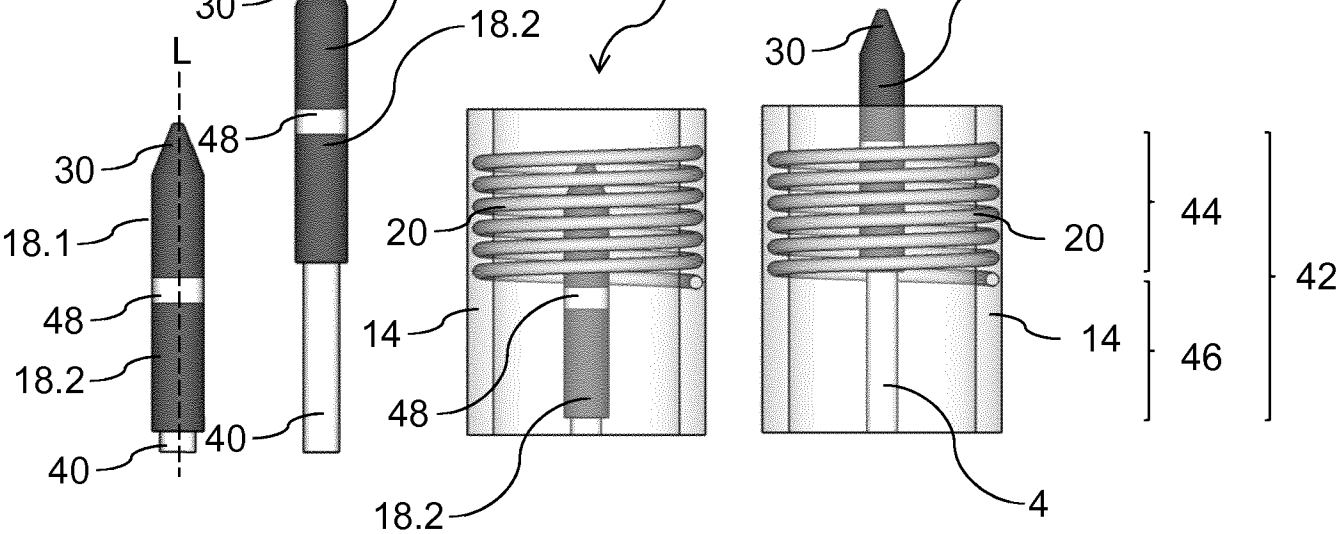
FIG. 7 shows an embodiment of a heating element with thermally insulated heating regions.

FIG. 7 shows an embodiment in which the heating element 18 comprises two thermally insulated heating regions 18.1, 18.2. The heating regions 18.1, 18.2 are separated from each other by a separating element 48, which facilitates a thermal insulation between the heating regions 18.1, 18.2. In FIGS. 7*a* and 7*b*, the heating element 18 is depicted moveable along the central axis L of the induction coil 20. FIGS. 7*c* and 7*d* show the induction coil 20 having a length 44 that corresponds to half the length of the chamber 16 and the length of one of the heating regions 18.1, 18.2. In this way, when a consumable 34 is inserted into the chamber 16 and pushed over the heating element 18, a first region of the consumable 34 with the length 44 corresponding to the length 44 of one of the heating regions 18.1, 18.2 can be heated. Thereafter, the heating element 18 can be partly pushed out of the chamber 16 such that a second portion of the consumable 34 can be heated.

Figure 8A:
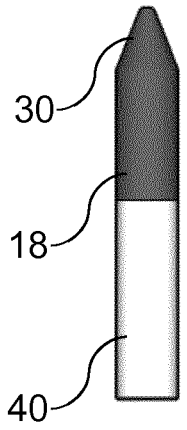
FIG. 8 shows an embodiment of fixed heating element and induction coil, in which only the consumable is moveable.
Figure 8B:
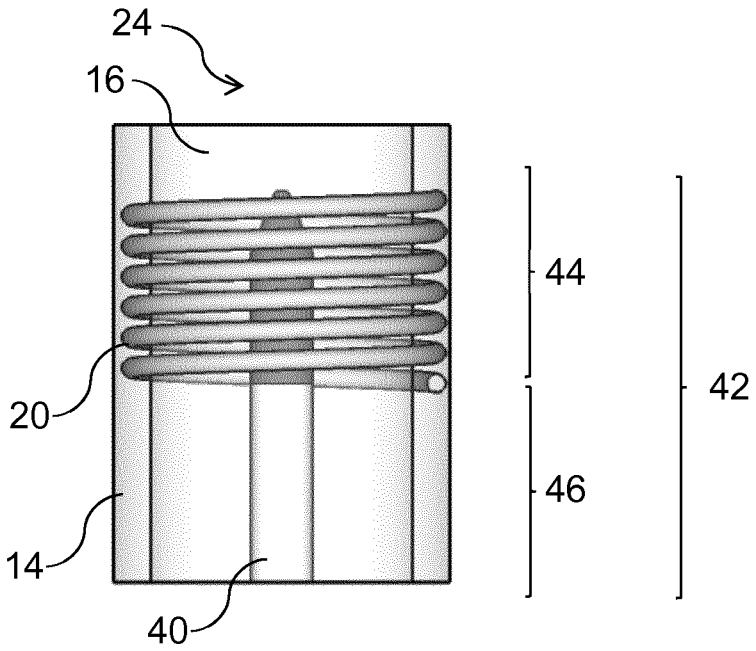

FIG. 8 shows an embodiment in which the heating element 18 and the induction coil 20 are fixed and only the consumable 34 can be moved within the chamber 16. The induction coil 20 has a length which corresponds to essentially half the length 44 of the chamber 16. The heating element also has a length which corresponds to essentially half the length 44 of the chamber 16. As can be seen in FIG. 8*b*, the induction coil 20 and the heating element 18 are arranged adjacent to the proximal end 24 of the device 10. When a consumable 34 is fully inserted into the chamber 16 and pushed over the heating element 18, a first portion of the consumable 34 of length 44 is heated. Subsequently, the consumable can be drawn partially out of the chamber 16 such that a second portion of the consumable 34 can be heated.

Figures 9A, 9B, 9C:
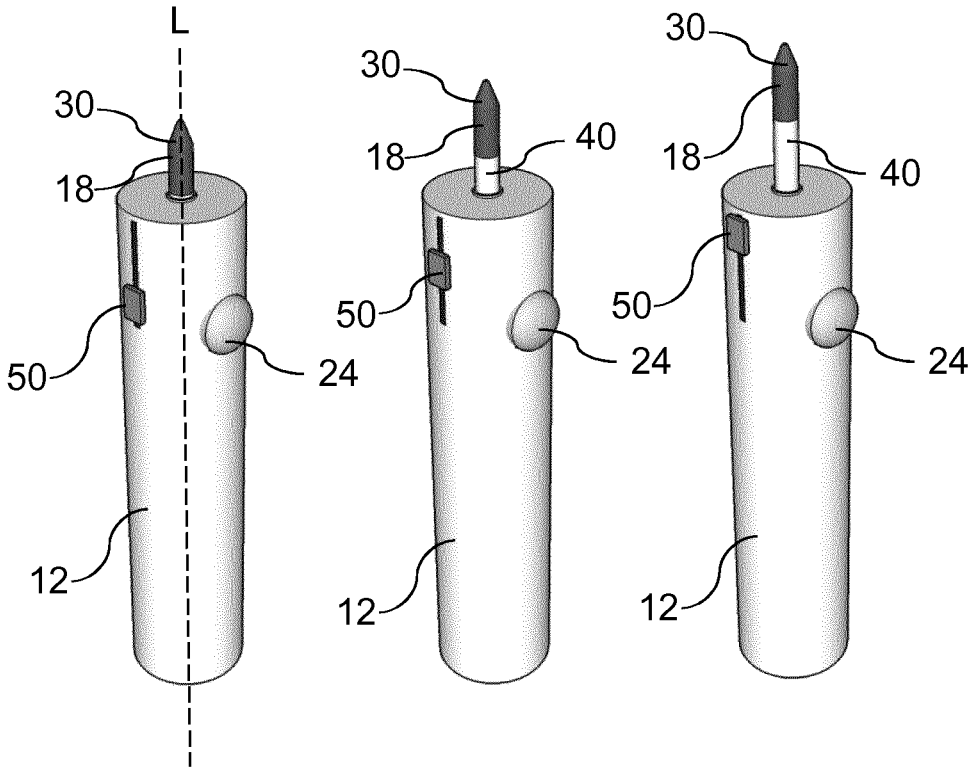
FIG. 9 shows a sliding actuator for moving the heating element.

FIG. 9 shows an embodiment in which a sliding actuator 50 is depicted for moving the heating element 18. FIGS. 9*a* to 9*c* show a movement of the sliding actuator 50 and the heating element 18 along the central axis L. The sliding actuator 50 is connected with the heating element 18 by means of connecting means such that a sliding action of the sliding actuator 50 is conveyed to the heating element 18 by the connecting means.

Figures 10A, 10B, 10C:
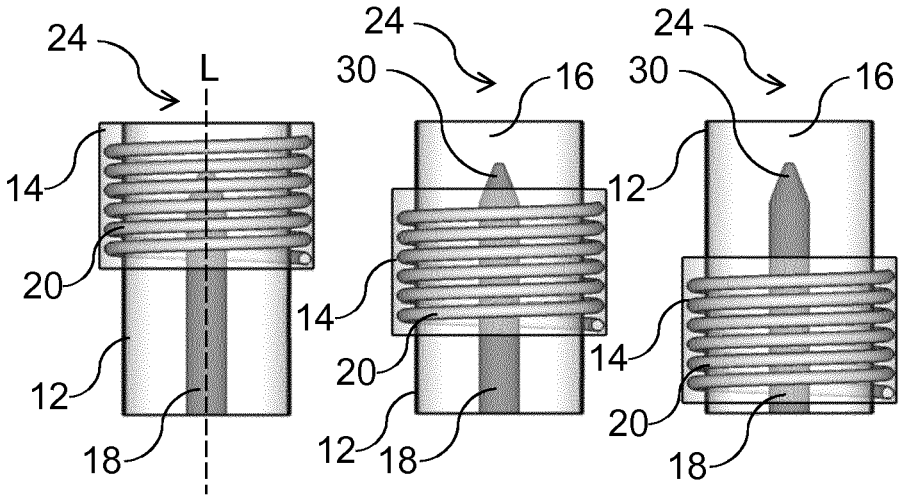
FIG. 10 shows an embodiment of the induction coil, in which the induction coil is arranged movable.

FIG. 10 shows the induction coil 20 being arranged movable along the central axis L. The second housing portion 14 is configured as a movable portion in which the induction coil 20 is arranged. The first housing portion 12 forms the chamber 16 and the second housing portion 14 is configured slidable along the first housing portion 12, see FIGS. 10*a* to 10*c*. This sliding action may be facilitated by a guiding element. When a consumable 34 is inserted into the chamber 16, different portions of the consumable 34 may be heated depending upon the positioning of the induction coil 20. Similar to FIG. 7, the heating element 18 may comprise heating regions 18.1, 18.2 with a length that corresponds to the length of the induction coil 20 such that only the heating region surrounded by the induction coil is heated at a time.

The invention is not limited to the described embodiments. The skilled person understands that the features which are described in the context of the different embodiments can be combined with each other within the scope of the invention.

The invention claimed is:

1. An aerosol-generating device, comprising:

a housing having a chamber configured to receive at least a portion of an aerosol-generating article; and an induction heater configured to heat the aerosol-generating article received within the chamber of the housing, the induction heater comprising an induction coil and a heating element, the heating element being arrangeable within the induction coil, and the induction coil being movable relative to the chamber of the housing, wherein the induction coil and the heating element are moveable with respect to each other between at least a first operable position and a second operable position.

2. The aerosol-generating device according to claim 1, wherein in the first operable position, a first portion of the heating element is surrounded by the induction coil, wherein in the second operable position, a second portion of the heating element is surrounded by the induction coil, and wherein the first portion and the second portion of the heating element do not overlap.

3. The aerosol-generating device according to claim 1, wherein the heating element is movable relative to the chamber of the housing.

4. The aerosol-generating device according to claim 3, wherein the heating element is movable in a longitudinal direction of the chamber.

5. The aerosol-generating device according to claim 3, further comprising a guiding element configured to restrict movement of the heating element within the chamber.

6. The aerosol-generating device according to claim 3, further comprising a sliding actuator configured to move the heating element within the chamber.

7. The aerosol-generating device according to claim 2, wherein the first portion and the second portion of the heating element are thermally isolated from each other.

8. The aerosol-generating device according to claim 1, wherein the induction coil is movable in a longitudinal direction of the chamber.

9. The aerosol-generating device according to claim 1, further comprising a guiding element configured to restrict movement of the induction coil relative to the chamber.

10. The aerosol-generating device according to claim 3, wherein the heating element is movable in a transverse direction of the chamber.

11. The aerosol-generating device according to claim 10, further comprising a base section, wherein the heating element is elongate and extends perpendicular to the base section into the chamber of the housing, and wherein the base section is configured to move between a first position in which the heating element is aligned with a central axis of the induction coil, and a second position in which the heating element is not aligned with the central axis of the induction coil.

12. The aerosol-generating device according to claim 11, wherein the base section comprises a dial and a pin offset from the central axis of the induction coil, the dial being configured to pivot about the pin.

13. The aerosol-generating device according to claim 11, wherein the base section comprises a sliding element configured to slide relative to a slot in the housing.

14. An aerosol-generating system, comprising:

an aerosol-generating article comprising an aerosol-generating substrate;

a housing having a chamber configured to receive at least a portion of the aerosol-generating article; and an induction heater configured to heat the aerosol-generating article received within the chamber of the housing, the induction heater comprising an induction coil and a heating element, wherein the heating element is arrangeable within the induction coil, wherein the induction coil is movable relative to the chamber of the housing, and wherein the induction coil and the heating element are moveable with respect to each other between at least a first operable position and a second operable position.

* * * * *